United States Patent [19]

Knight

[11] Patent Number: 4,802,518

[45] Date of Patent: Feb. 7, 1989

[54] LOG CUTTING MACHINE

[75] Inventor: May Knight, Leek, England

[73] Assignee: David John Knight, Cheddleton, England

[21] Appl. No.: 96,625

[22] Filed: Sep. 14, 1987

[30] Foreign Application Priority Data

Sep. 12, 1986 [GB] United Kingdom ..... 8621986

[51] Int. Cl.[4] ..... B27L 7/00

[52] U.S. Cl. ..... 144/193 R; 144/366

[58] Field of Search ..... 144/193 R, 3 K, 366

[56] References Cited

U.S. PATENT DOCUMENTS 1,598,695 9/1926 Anderson ..... 144/193 R
1,666,795 4/1928 Schmidt ..... 144/193 R
2,493,914 1/1950 Corsy et al. ..... 144/193 R
2,565,406 8/1951 Stennitt ..... 144/193 R

*Primary Examiner*—W. Donald Bray
*Attorney, Agent, or Firm*—Anthony J. Casella; Gerald E. Hespos

[57] ABSTRACT

A log cutting machine is provided which has a cyclic operation to achieve high operating speeds. The log cutting machine comprises a pivotal support which carries a cutting blade. A cranked drive is operatively connected to the pivotal support to effect cyclic movement of the cutting blade carried by the pivotal support. A reaction surface is disposed in proximity to the movable cutting blade such that the blade moves toward and away from the reaction surface during the cyclic operation of the cutting machine.

16 Claims, 3 Drawing Sheets

LOG CUTTING MACHINE

The present invention relates to a log cutting machine.

In particular the present invention relates to a mechanically powered log cutting machine for cutting and processing timber into logs for use, for example, as firewood. Various machines already exist for cutting and processing logs. Predominantly circular saws are used with a number of modifications to enhance operator safety. These circular saws are often used in conjunction with a hydraulically powered splitting device which is used to reduce large diameter logs to a usable size. Hydraulically powered guillotines are also used to cut through large boughs and/or tree trunks. However, whilst each of the above known machines are effective in their own way, they are relatively slow in their cutting action.

The aim of the present invention is to provide a log cutting machine which provides a cyclic cutting action which is rapid in comparison with the above prior art machines.

According to the present invention there is provided a log cutting machine comprising a pivotal support which carries a cutting blade, the cutting blade, in use, acting with a reaction surface to produce the required cutting action, said support being pivotal by a cranked drive via a sliding mechanism.

In a preferred embodiment of the present invention the pivotal support comprises two parallel bars on which a sliding mechanism is mounted, the bars being joined together at each end region so as to form a support for the cutting blade at one end of the pivotal support and a pivot point at the other end. The pivot point is pivotally carried on a general framework for the machine with the cranked drive connected to said sliding mechanism also supported on said framework. The cranked drive may be designed for circular or elliptical motion. Rotation of the cranked drive by either a suitable motor carried by the framework or, for example, by a power take-off of a tractor carrying the framework, causes the pivotal support to pivot about said pivot point, the sliding mechanism moving back and forth along the parallel bars. The pivotal motion moves the cutting blade towards and away from the reaction surface which may be formed by a tubular mandrel supported on the framework so as to be parallel to the cutting edge of the cutting blade when the cutting blade has attained the limit of a cutting stroke. Preferably the cutting blade can contact the tubular mandrel in this limit position, the blade being preferably set to one side of the tubular reaction surface so that the blade engages the reaction surface at an angle, thus reducing the possibility of hard impact and damage to the blade and/or drive. Alternatively the reaction surface may be formed as two back-to-back inclined ramps with a gap therebetween, the blade moving into the gap at the end of its cutting stroke.

By using such a tubular mandrel or back-to-back inclined ramps to form the reaction surface, the severed logs fall away as they are cut, obviating the danger of the cutting blade jamming between severed parts of a log, as can happen when an extensive planar reaction surface is provided.

Preferably an energy storage device in the form of a leaf spring is also mounted on the framework, the end regions of the leaf spring being connected to the framework with the middle region pivotally connected to an extension of the pivot point region of said pivotal support for the cutting blade. Thus, as the cranked drive operates to move the cutting blade away from the tubular reaction surface the leaf spring is tensioned by the drive, the energy thus stored in the spring being released as the cranked drive moves the cutting blade towards the reaction surface in a cutting stroke; the energy released enhancing the power of the cutting stroke.

In use, the cutting blade moves continuously towards and away from the reaction surface. Thus, as the blade clears the diameter of a log being processed, during its movement away from the reaction surface, the log can be manually or mechanically moved axially through a required axial distance under the path of the cutting blade. The cutting stroke powered by the drive and the energy storage device, then severs the required log length and the log can be subsequently moved axially as the blade moves away from the reaction surface.

Advantageously an endless covneyor can be positioned adjacent to one side of the reaction surface so as to convey logs away from the machine to a desired location as they are cut. Preferably the conveyor is driven by the same motor as the cranked drive.

The present invention will now be further described, by way of example, with reference to the accompanying drawings, in which.

Figure 1:
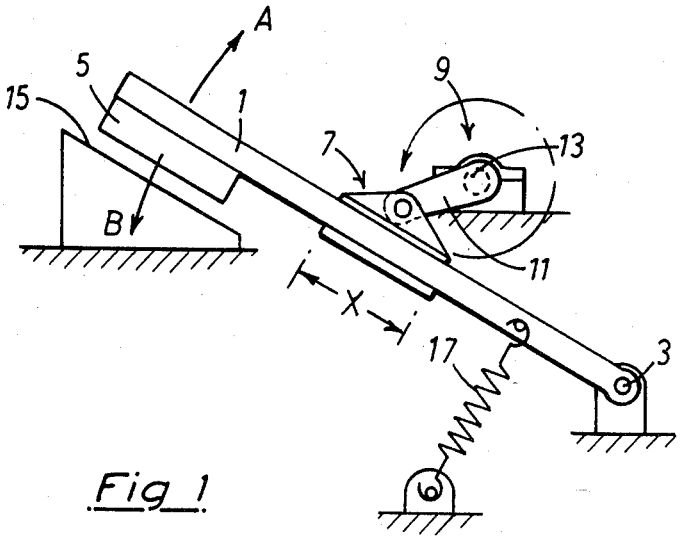
FIG. 1 is a schematic illustration of the present invention.

As seen in FIG. 1 of the accompanying drawings, the log cutting machine of the present invention comprises a pivotal support 1 which is pivotally carried at one end on fixed point 3, a cutting blade 5 being mounted on the other end region of said pivotal support 1. A sliding mechanism 7 is slidable back and forth along part of said pivotal support and is connected to a crank drive 9 comprising an elongate arm 11 pivotally connected to the sliding mechanism 7 and fixedly connected to a drive axle 13. Rotation of the drive axle 13 by suitable motor means thus causes the pivotal support 1 to pivot back and forth in directions 'A' and 'B' respectively; the sliding mechanism 7 moving in directions 'X' and 'Y' respectively. As the pivot support 1 moves in direction 'A' away from reaction surface 15, an energy storage device in the form of a spring 17 is tensioned, energy being thus stored in the spring 17. Thus, when the pivotal support 1 is moved in direction 'B' towards the reaction surface 15 to perform a cutting stroke, the energy stored in the spring 17 is released to add to the power of the crank drive 9, thus improving the power of the cutting stroke.

Figure 2:
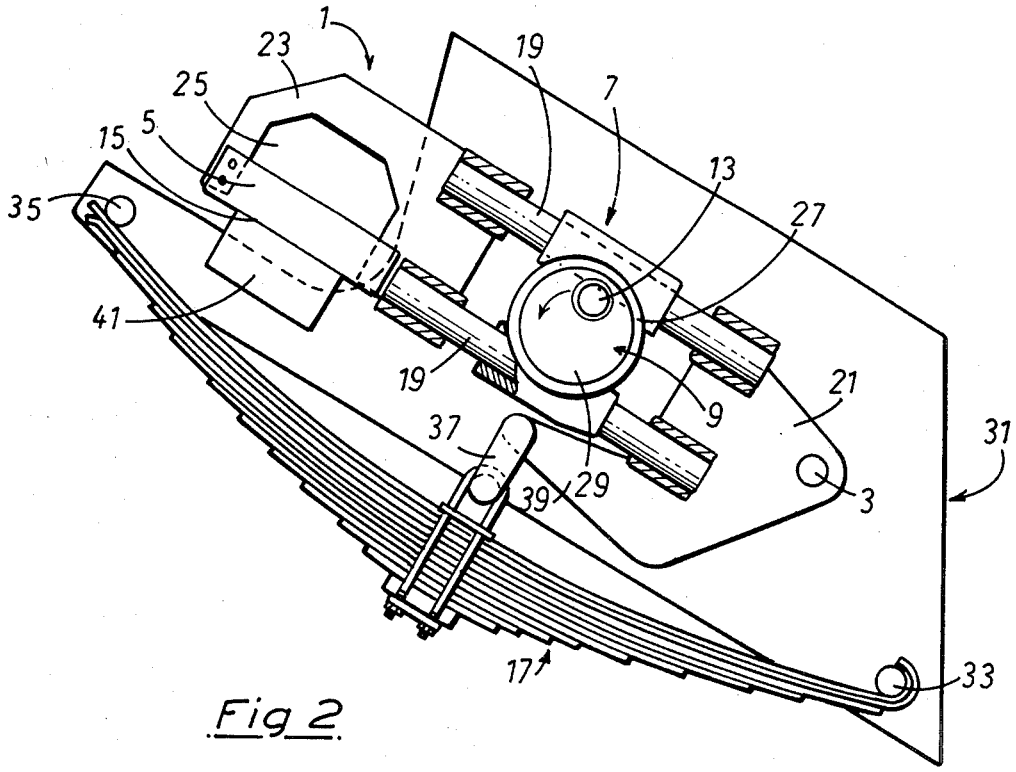
FIG. 2 is a diagrammatic side view of part of a one embodiment of the present invention.

In the embodiment of the present invention illustrated in FIG. 2 of the accompanying drawings, the same reference numerals as used in FIG. 1 will be used to indicated equivalent components. The pivotal support 1 in the embodiment of FIG. 2 basically comprises two parallel bars 19 inter-connected at one end to form a pivot point region 21 and interconnected at the other end to form a cutting blade support 23. The cutting blade support 23 is formed with an inverted U-shaped recess 25 which effectively limits the maximum diameter of log to be cut, and across the mouth of which the cutting blade 5 extends. The cutting blade 5 is preferably tensioned along its length to reduce the likelihood of deflection during a cutting stroke.

The sliding mechanism 7 is slidable back and forth on both parallel bars 19 and incorporates the crank drive 9. The sliding mechanism 7 essentially comprises an open-ended generally cylindrical housing 27 having two lateral extensions 28, each extension 28 having a bore through which a bar 19 axially slidably extends. A circular disc-like drive member 29 is rotatably located and retained within a complementary cavity or recess in the housing 27 and together with a drive axle 13, forms said crank drive 9. The drive axle 13 is fixedly secured to the drive member 29 so as to extend axially of the disc-like drive member 29 from a position offset from the centre of the disc-like drive member 29, and is rotatably mounted at a fixed point in a framework 31 to which the pivot point region 21 is likewise connected. Thus, by connecting a suitable drive, e.g. a motor mounted on the framework or a power take off of a tractor, to the drive axle 13 via a suitable reduction gear 47 (see FIG. 4), the drive member 29 and housing 27 move eccentrically causing the sliding mechanism 7 to move likewise, resulting in the pivotal support 1 pivoting in directions 'A' and 'B' sequentially.

The energy storage device is in the form of a semi-elliptical leaf spring 17 which is pivotally connected at one end, as at 33, to the framework 31, and engaged against a roller stop 35 on the framework 31, at its other end region. The middle region of the spring 17 is pivotally connected by a mechanical linkage 37 to an extension 39 of the pivot point region 21 of the pivotal support 1. Thus, as the pivotal support 1 is pivoted in direction 'A', the spring 17 is tensioned, i.e. flexed, said other end region moving over the roller stop 35, and potential energy is stored in the spring 17. When the pivotal support 1 is moved by the drive in direction 'B' towards the reaction surface 15, the power of this cutting stroke is enhanced by the release of the potential energy stored in the spring 17.

The reaction surface 15 is provided by a tubular mandrel 41 which is positioned so that its longitudinal axis is parallel to the cutting edge of the cutting blade 5 when the cutting blade has completed its cutting stroke, but to one side of the cutting edge when considering the plane of the cutting blade 5. In this way the cutting blade performs only a glancing contact with the reaction surface, reducing the possibility of blade and/or drive damage due to hard impact. Preferably the position of the mandrel 41 is adjustable and, if desired, the reaction surface can be alternatively provided by a fixed or adjustable table. The advantage of the tubular mandrel is that the severed part of the log can fall away unhindered as it is cut, avoiding the possibility of the cutting blade jamming between the severed parts. Such jamming could stress and damage the machine.

In use, a selected log can be manually or mechanically slid onto the mandrel 41 in a direction normal to the available pivotal motion, the log being moved under the cutting blade 5 as the blade 5 clears the log during its movement in direction 'A'. The subsequent cutting stroke in direction 'B', powered by the drive together with the energy stored in spring 17, then slices through the log, the inverted U-shaped recess 25 engaging around the log and dictating the maximum diameter of log which can be processed.

Figure 3:
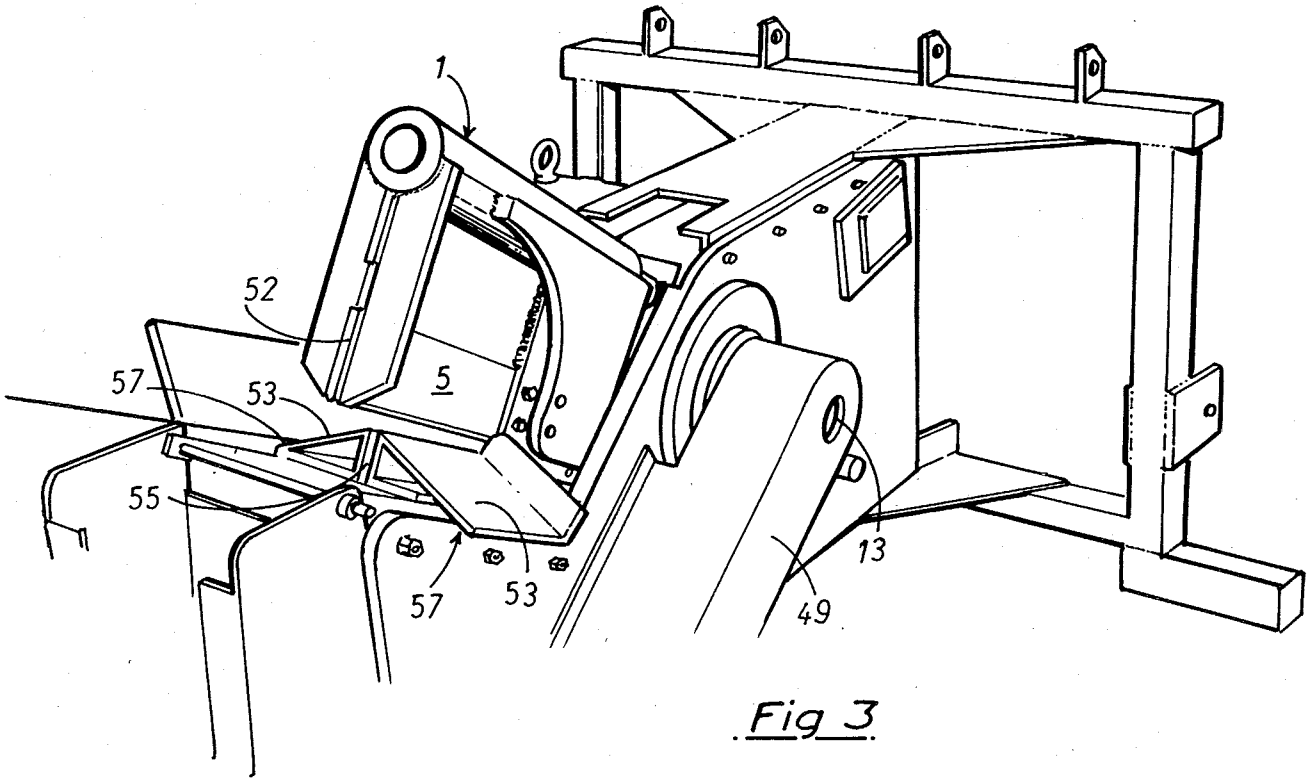
FIG. 3 is a perspective view of a part of a preferred embodiment of the present invention.
Figure 4:
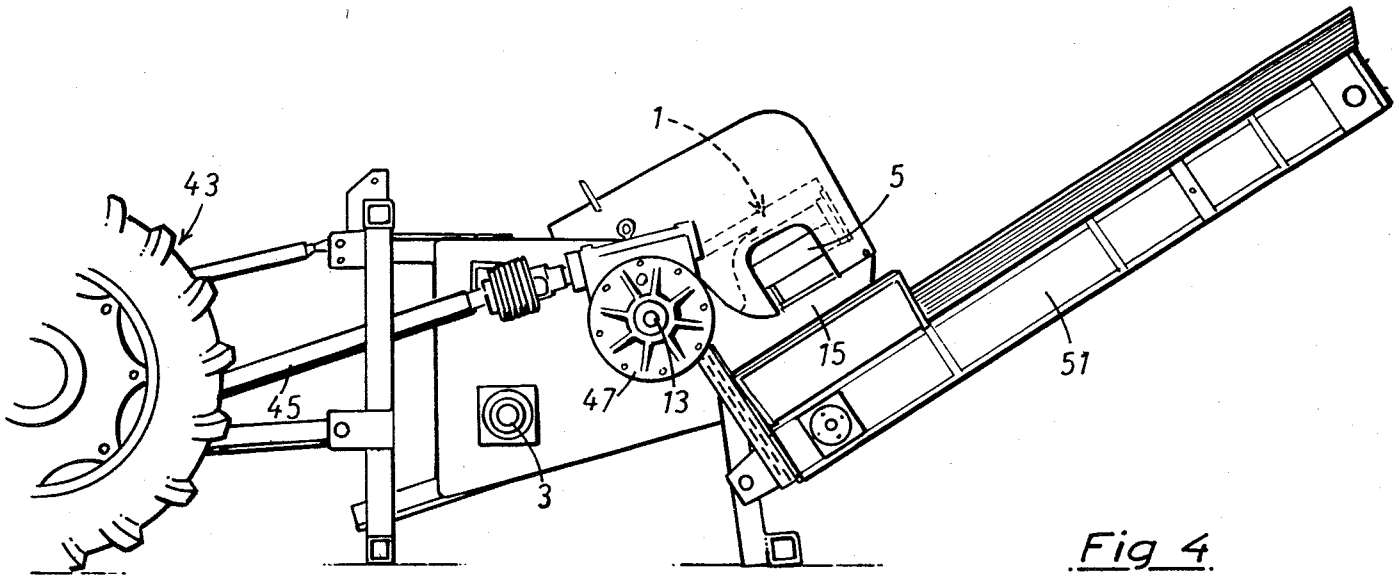
FIG. 4 is a side view of the preferred embodiment of FIG. 3.

Whilst a suitable motor can be mounted on the framework 31 and connected to the drive axle 13, it is envisaged that the machine may more usefully be mounted on the rear of a tractor with the drive axle 13 coupled to the tractor power take off via a suitable reduction gear as shown in the preferred embodiment of FIGS. 3 and 4. In this way the machine can be taken to a desired site to process logs, as required.

The preferred embodiment of FIGS. 3 and 4 has basically the same internal structure as shown diagrammatically in FIG. 2, and like reference numerals will be used in FIGS. 3 and 4 to identify equivelant parts. As shown this preferred embodiment is mounted on the rear of a tractor 43 and a drive shaft 45 connected to the power take-off of the tractor 43 connects with a reduction gear 47 which drives the drive axle 13. The reduction gear 47 connects with one end region of the drive axle 13 and the other end region of the drive axle 13 drives an endless chain (not shown) within casing 49, the endless chain driving an endless conveyor 51, one end region of which is located adjacent to one side of the reaction surface 15. In this way the endless conveyor 51 is powered by the tractor power take-off, and logs can be conveyed sequentially away to a desired location immediately they have been cut. Further to strengthen the support of the cutting blade 5, the generally rectangular blade is located in a slot 52 on the pivotal support 1 so that it is engaged along the length of its rear edge, and the blade is tensioned along its length by suitable sever means. The reaction surface 15 with which the cutting blade acts is formed by two oppositely inclined surfaces 53 with a gap 55 formed therebetween. These inclined surfaces 53 and gap 55 are formed by two back-to-back ramps 57, the cutting balde 5 moving into the gap towards the end of its cutting stroke. Thus the severed part of a log can pull away as it is cut, thereby avoiding jamming the entry of the cutting blade 5 into the gap 55 ensures a complete cut at all times.

Whilst the above desired embodiments utilise a crank drive having a circular motion, a crank drive having an elliptical motion can equally well be substitued, if desired.

The present invention thus provides a simple log cutting machine which can be efficiently used to cut logs from any selected raw materials.

I claim:

1.A log cutting machine comprising a pivotal support carrying a cutting blade, a reaction surface defined by two spaced apart oppositely inclined back-to-back ramps defining a gap therebetween, said cutting blade being movable into the gap between said ramps of said reaction surface upon pivoting of said support, a cranked drive apparatus, and connecting means movably connected to both said pivotal support and said cranked drive apparatus for effecting cyclic pivotal movement of said cutting blade toward and away from said reaction surface.

2. A machine according to claim 1, wherein the pivotal support includes two parallel bars on which a housing is slidably mounted, said housing and said bars forming said connecting means, adjacent end regions of the parallel bars being joined together with one end region of the thus formed support carrying the cutting blade whilst the other end region is attached to a pivot point.

3. A machine according to claim 2, wherein the pivot point is carried in a general framework of the machine with the cranked drive also supported on said framework.

4. A machine according to claim 1, wherein an energy storage device is attached between a fixed point and the pivotal support so that energy is stored in said storage device as the pivotal support moves the cutting blade away from the reaction surface.

5. A machine according to claim 4, wherein the energy storage device is in the form of a spring.

6. A machine according to claim 5, wherein the spring is a leaf spring which is pivotally mounted at one end region and engaged against a stop at the other end region, the middle region of the leaf spring being connected to said pivotal support.

7. A log cutting machine comprising a support pivotally mounted to a framework of said machine at a pivot point thereon, said support comprising a cutting blade mounted to a location spaced from said pivot point such that said cutting blade is pivotally movable relative to said pivot point, said support further comprising a pair of parallel bars on which a housing is slidably mounted, a cranked drive mounted to said framework and pivotally connected to said housing and a reaction surface toward which said cutting blade is movable for producing the required cutting action.

8. A machine according to claim 7, wherein the cranked drive comprises a cylindrical cavity in said housing, the axis of said cavity extending perpendicular to the said parallel bars, with a complementary disc-like drive member being rotatably located and retained in the cavity, said drive member having a drive axle which extends axially of the drive member from a position offset from the centre of the disc-like drive member, through an open-end of the cavity.

9. A machine according to claim 8, wherein the drive axle is rotatably supported in bearings in said general framework.

10. A machine according to claim 9, wherein the drive axle is connected to a reduction gear which is adapted to be driven by a power source.

11. A machine according to claim 10, wherein the power source is the power take-off of a tractor.

12. A machine according to claim 10, wherein the drive axle is operative to drive an endless conveyor which can convey cut material away from the region of the reaction surface.

13. A machine according to claim 7, wherein the reaction surface is formed by two oppositely inclined surfaces.

14. A machine according to claim 13, wherein said oppositely inclined surfaces are formed by two back-to-back ramps which are spaced apart from each other to allow the cutting blade to move into the gap therebetween towards the end of the cutting stroke.

15. A machine according to claim 1, wherein the reaction surface is formed by a cylindrical mandrel which extends parallel to the cutting edge of the cutting blade.

16. A machine according to claim 15, wherein the cylindrical mandrel is offset to one side of the cutting blade.

* * * * *